United States Patent [19]

Walker

[11] Patent Number: 4,644,597

[45] Date of Patent: Feb. 24, 1987

[54] AIR MATTRESS WITH PRESSURE RELIEF VALVE

[75] Inventor: Robert A. Walker, Minneapolis, Minn.

[73] Assignee: Dynatech, Inc., Greenville, S.C.

[21] Appl. No.: 726,608

[22] Filed: Apr. 24, 1985

Related U.S. Application Data

[63] Continuation-in-part of Ser. No. 492,954, May 9, 1983, abandoned.

[51] Int. Cl.[4] ..... A47C 27/08

[52] U.S. Cl. ..... 5/449; 5/453; 5/455; 5/468

[58] Field of Search ..... 5/449, 453–455, 5/468; 137/224, 511, 535

[56] References Cited

U.S. PATENT DOCUMENTS

| | | | |
|---|---|---|---|
| 585,834 | 7/1897 | Ruth | 5/455 |
| 1,282,980 | 10/1918 | Takach | 5/349 |
| 1,382,831 | 6/1921 | Hilker | 5/449 |
| 2,059,226 | 11/1936 | Gates | 5/468 |
| 2,415,150 | 2/1947 | Stein | 5/455 |
| 2,549,597 | 4/1951 | Harris et al. | 5/348 |
| 2,741,780 | 4/1956 | Kimbrig | 5/348 |
| 2,842,783 | 7/1958 | Druck | 5/348 |
| 3,128,480 | 4/1964 | Lineback | 5/348 |
| 3,310,081 | 3/1967 | Fisher | 5/348 |
| 3,505,695 | 4/1970 | Bishaf et al. | 5/348 |
| 3,536,071 | 10/1970 | Ferrando | 128/142.5 |
| 3,790,975 | 2/1974 | Philipp et al. | 5/349 |
| 4,025,974 | 5/1977 | Lea et al. | 5/453 |
| 4,149,285 | 4/1979 | Stanton | 5/453 |
| 4,169,295 | 10/1979 | Darling | 5/450 |
| 4,371,999 | 2/1983 | Reid | 5/457 |

*Primary Examiner*—Gary L. Smith
*Assistant Examiner*—Michael F. Trettel
*Attorney, Agent, or Firm*—Burd, Bartz & Gutenkauf

[57] ABSTRACT

An air mattress is equipped with a one-way air pressure relief valve operable to limit the air pressure in the air mattress to about 1 psi to prevent seam separation and blowout. The mattress has top and bottom walls joined to side and end walls with edge seams. The air pressure relief valve is located within the chamber of the air mattress so that external structures do not interfere with the functioning of the valve. In one arrangement, a boot secures the air pressure relief valve to the inside of an end wall. In a second arrangement, the air pressure relief valve is located within the seam.

20 Claims, 20 Drawing Figures

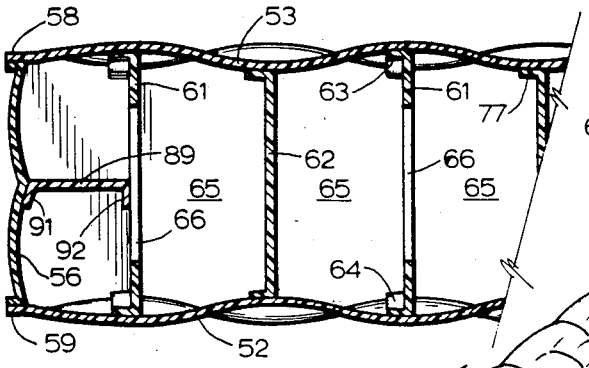
FIG. 12
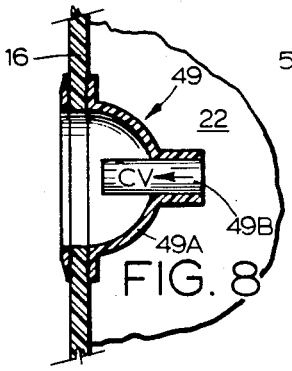
FIG. 8
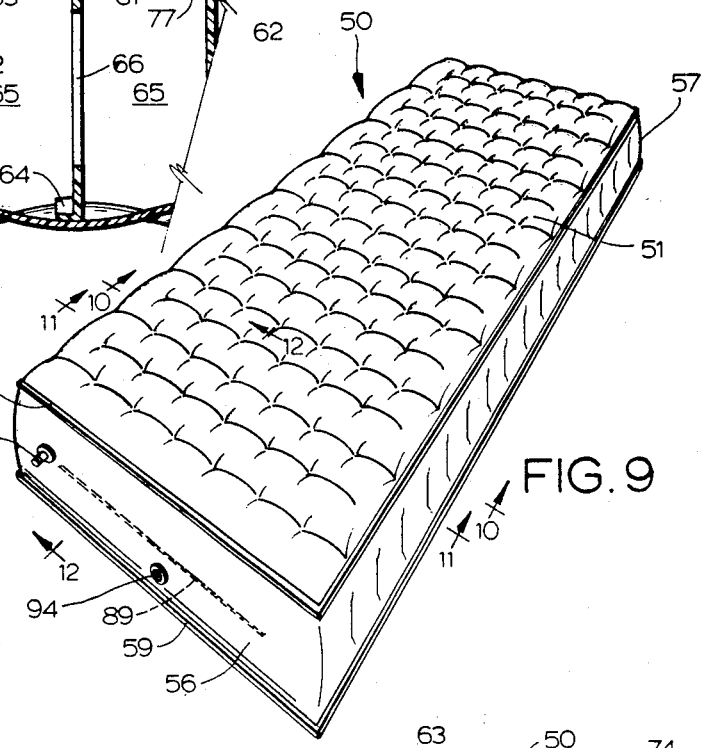
FIG. 9
FIG. 10
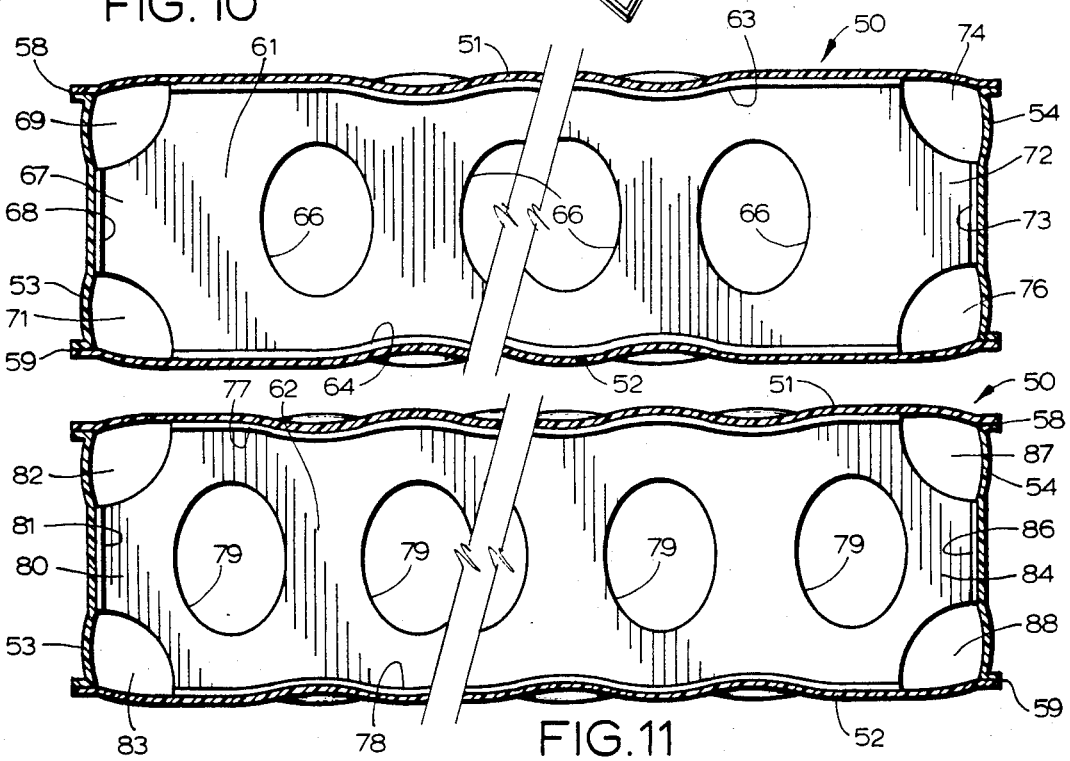
FIG. 11

FIG. 16
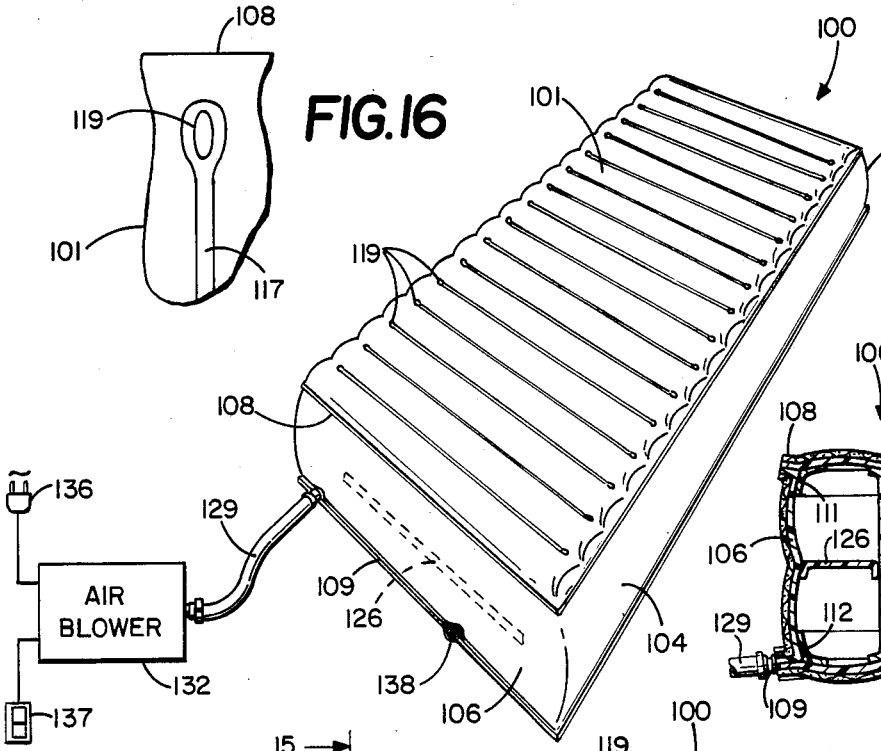
FIG. 13
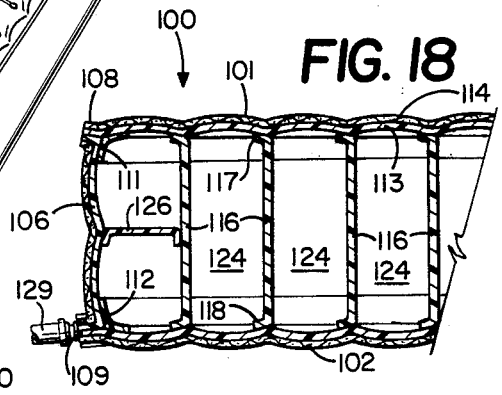
FIG. 18
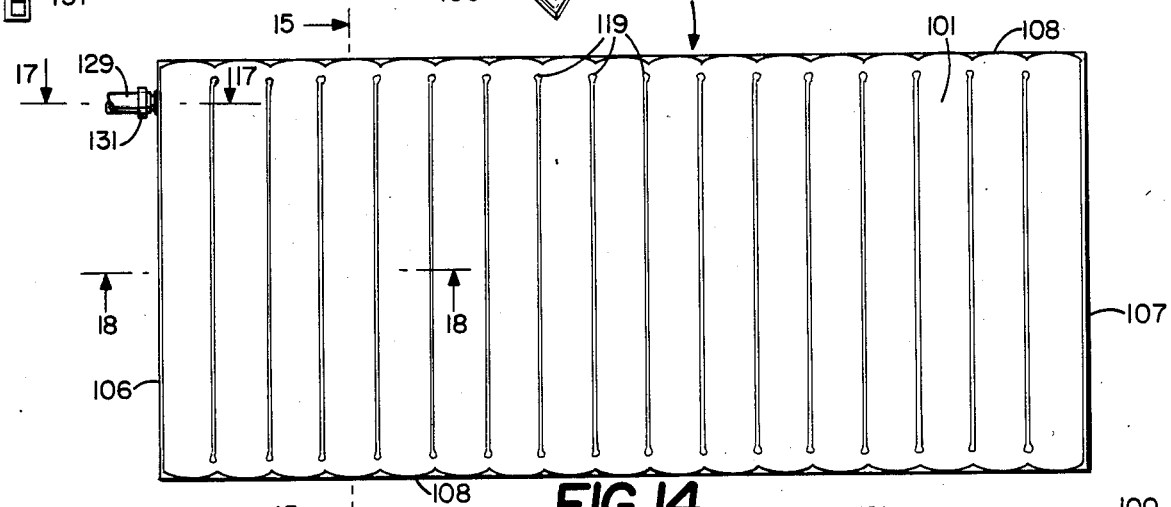
FIG. 14
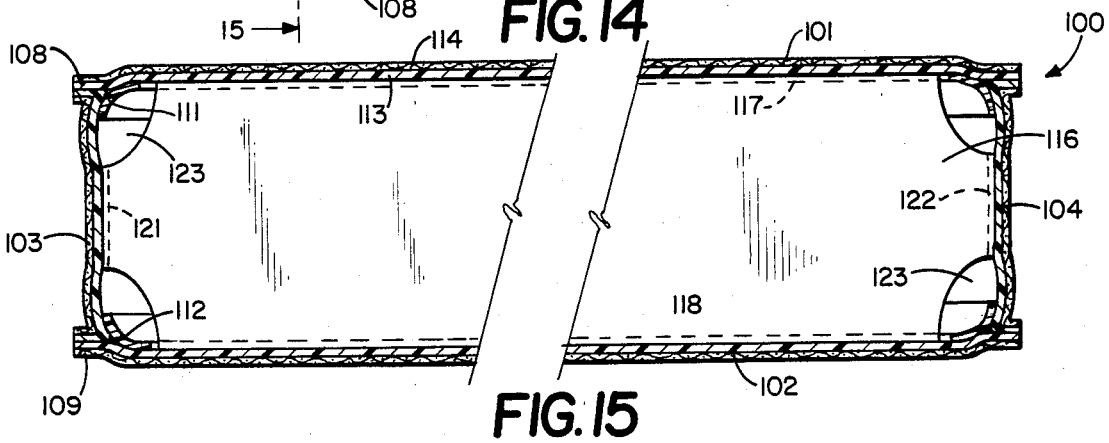
FIG. 15

AIR MATTRESS WITH PRESSURE RELIEF VALVE

CROSS REFERENCE TO RELATED APPLICATION

This application is a continuation-in-part of U.S. Application Ser. No. 492,954 filed May 9, 1983, now abandoned.

FIELD OF INVENTION

This invention relates to inflatable supports, such as air mattresses, for use in air beds.

BACKGROUND OF INVENTION

Air mattresses are used with cots and beds to provide yieldable body supports. The air mattresses are air-filled bags having flexible air impervious sheet members secured together to form one or more longitudinal chambers for accommodating air under pressure. Air mattresses have air inlet tubes that are used with hand-operated pumps, bag pumps, and other sources of air under pressure to inflate the mattresses. Plugs are used to close the tubes after the mattresses are inflated with air. Conventional air mattresses do not have pressure relief valves so that they can be easily over-inflated, causing rupture of the mattress material or the separation of the seams. An over-inflated air mattress is relatively hard and can become mis-shaped and wobbly.

SUMMARY OF INVENTION

The invention is a fluid accommodating apparatus or mattress providing a support for a body, such as a human body. The mattress preferably accommodates air under pressure, such as 1 psi or less. A pressure relief valve is operable to insure that the air pressure is maintained below a predetermined value so as not to over-inflate the mattress. The mattress is adapted to be coupled to a pump means operable to provide a supply of air under pressure to the mattress and allow air to exhaust from the mattress. The mattress has top and bottom walls that are connected together with side walls and end walls to form an enclosed air impervious chamber. The chamber is divided into a plurality of connected transverse gas accommodating passages with a plurality of beams or webs. Each web is joined to the top and bottom walls and the side walls and functions to limit outward expansion of the walls. An air inlet means secured to one of the walls is useable to facilitate the supply of fluid under pressure into the passages.

According to the invention, there is provided an air mattress having flexible top and bottom walls located in spaced relation relative to each other. First and second side walls and end walls are joined to the outer edges of the top and bottom walls to form an enclosed chamber for accommodating air under pressure. An air inlet means associated with one of the walls is used to carry air from a source of air under pressure into the air mattress.

A plurality of transverse sheet beams or webs are secured to the top and bottom walls and side walls to maintain the air mattress in a box-like shape. Horizontal ribs associated with the front and rear walls and front and rear transverse webs are used to reinforce the front and rear walls and maintain their upright positions when the mattress is inflated with air. The opposite ends of the transverse webs have openings to allow air to flow into and out of the transverse air chambers. The walls and webs are Nylon fabric and vinyl plastic sheet members sealed together. These sheet members are air impervious and form seals that do not tear or rip apart in use. A one-way air pressure relief mounted on a wall prevents over-inflation of the air mattress. The pressure relief valve in one embodiment of the invention has a flexible boot supporting a valve body within the chamber. The valve body supports a movable spring-biased valving member operable to allow air to evacuate from within the air mattresses when the pressure exceeds a selected level, such as 1 psi.

In one form of the air mattress, the transverse webs have holes to allow limited expansion of separate portions of the top and bottom walls of the air mattress. This results in a mattress surface having a tuffed convex shape.

IN THE DRAWING

FIG. 8 is an enlarged sectional view taken along the line 8—8 of FIG. 5;

FIG. 9 is a perspective view of a modification of the air mattress of the invention;

FIG. 10 is an enlarged foreshortened sectional view taken along the line 10—10 of FIG. 9;

FIG. 11 is an enlarged foreshortened sectional view taken along the line 11—11 of FIG. 9;

FIG. 12 is an enlarged sectional view taken along the line 12—12 of FIG. 9.

FIG. 13 is a perspective view of another modification on the air mattress having an air pressure relief valve of the invention connected to an air blower;

FIG. 14 is an enlarged top plan view of the air mattress of FIG. 13;

FIG. 15 is an enlarged foreshortened sectional view taken along the line 15—15 of FIG. 14;

FIG. 16 is an enlarged top plan view of a portion of the air mattress of FIG. 14;

FIG. 18 is a sectional view taken along the line 18—18 of FIG. 14;

DESCRIPTION OF PREFERRED EMBODIMENTS

Figures 1, 2, 3, 4, 5, 6, 7:
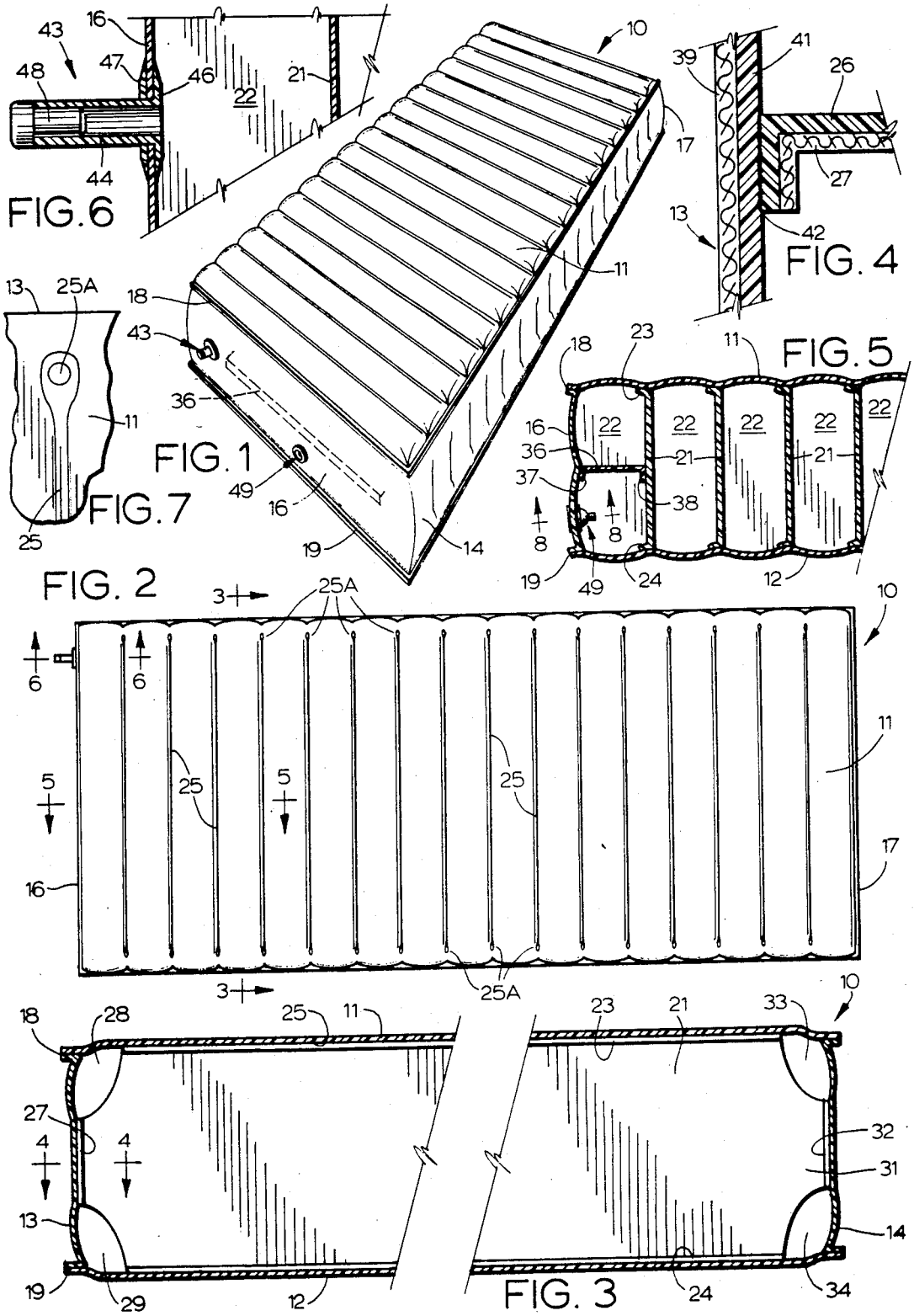
FIG. 1 is a perspective view of an air mattress having an air pressure relief valve of the invention.
FIG. 2 is an enlarged top plan view of the mattress of FIG. 1.
FIG. 3 is an enlarged foreshortened sectional view taken along the line 3—3 of FIG. 2.
FIG. 4 is an enlarged sectional view taken along the line 4—4 of FIG. 3.
FIG. 5 is an enlarged sectional view taken along the line 5—5 of FIG. 2.
FIG. 6 is an enlarged sectional view taken along the line 6—6 of FIG. 2.
FIG. 7 is an enlarged plan view of a portion of the top of the apparatus.

Referring to FIGS. 1 and 2, there is shown a fluid accommodating air mattress having an air pressure relief valve of the invention indicated generally at 10 useable to yieldably support an object. Apparatus 10 accommodates a compressible fluid, such as air, to yieldably support an object in a horizontal position. The apparatus is preferably an air mattress, or bladder used in an air bed to yieldably support one or more prone persons.

Air mattress 10 has a generally rectangular top wall 11 located over a rectangular bottom wall 12. Side walls 13 and 14 and end walls 16 and 17 are secured to the outer peripheral edges of top and bottom walls 11 and 12. Upper and lower continuous peripheral seals 18 and 19 join the adjacent edges of walls 11–14 and 16 and 17. Seals 18 and 19 are ultrasonic fluid impervious connections that permanently join peripheral adjacent portions of walls 11–14 and 16 and 17 together. Seals 18 and 19 are lap seams forming the outer peripheral edges of the air mattress.

As shown in FIGS. 3 and 5, a plurality of laterally spaced transverse internal webs or beam supports 21 linearly extend between side walls 13 and 14. Each support 21 has a body or web section and opposite end portions. The upper edges of the web sections of supports 21 have lips 23 that are secured to the inside surface of upper wall 11. The lower portions of the web sections have lower lips 24 that are secured to the inside surface of bottom wall 12. Seals 25 are utilized to secure lips 23 and 24 to the upper and lower walls 12. Seals 25 extend transversely across top and bottom walls 11 and 12 and terminate in enlarged ends 25A.

As shown in FIG. 7, each end 25A has an enlarged tear drop shape spaced inwardly from adjacent side walls 13 and 14 to provide air passages 28 and 33. The enlarged ends 25A strengthen the ends of each seal. Webs 21 are flexible, non-elastic sheet members that prevent the upper and lower walls 11 and 12 from ballooning or bulging outwardly. Webs 21 divide the interior of apparatus 10 into a plurality of transverse fluid accommodating passages or chambers 22. Chambers 22 extend transversely across apparatus 10 and are located side-by-side between the end walls 16 and 17.

As shown in FIGS. 1 and 2, transverse webs 21 are equally spaced from each other along the longitudinal dimension or length of air mattress. Adjacent webs 21 provide separate transverse gas passages or chambers 22. Adjacent webs 21 are preferably laterally spaced about 10 cm. Other lateral dimensions between adjacent webs 2 may be used. Webs 21 vertically reinforce top and bottom walls 11 and 12 and restrict outward expansion or bulging of these walls. Webs 21 also laterally reinforce the opposite side walls 13 and 14 and restrict outward expansion of these walls. All of webs 21 cooperate with the top, bottom, and side walls 11, 12, 13, 14, 16 and 17 to retain the box shape of air mattress 10.

Referring to FIG. 3, internal support 21 has a first end portion 26 terminating in a right angle turned ear 27. The ear 27 is secured by an ultrasonic seal to the mid-portion of side wall 13. Openings 28 and 29 are located adjacent upper and lower sides of end portion 26 to permit gas to flow into the end of an adjacent chamber 22. The opposite end of support 21 has a second end portion 31 terminating in a right angle turned to ear 32. Ear 32 is secured to the mid-portion of end wall 14. Openings 33 and 34 located on opposite sides of second end portion 31 allowing gas to flow into the end of an adjacent air chamber 22. The first and second end portions 26 and 31 retain side walls 13 and 14 in generally upright positions when the pressure of the gas in the chambers 22 is increased. Each of supports 21 has end portions that are secured to middle portions of the side walls 13 and 14.

As shown in FIG. 5, a generally horizontal end support or rib 36 is provided with lips 37 and 38. Lip 37 is secured to the mid-portion of end wall 16. Lip 38 is secured to the adjacent internal support 21. The horizontal support retains end wall 16 in a generally upright position, as shown in FIG. 1. The opposite end of air mattress 10 has a generally horizontal support (not shown) that is identical to support 36 to retain end wall 17 in a generally vertical position.

As shown in FIG. 4, side wall 13 is a fabric plastic sheet member comprising an outer fabric layer 39 and an inner plastic layer 41. The layers 39 and 41 are integrally joined together to form an air impervious wall. Seal 42 joins ear 27 to the mid-portion of side wall 13. The side wall can be a Nylon vinyl, polyester vinyl, or Rayon vinyl. These materials are flexible, strong, and air impervious. They also do not deteriorate over time and are water-resistant.

Referring to FIGS. 1 and 6, a plug tube assembly indicated generally at 43 is secured to one end of the end wall 16. Assembly 43 is used as an inlet passageway to allow gas to flow into chambers 22. The gas can be derived from a pump, such as an air pump or blower. Assembly 43 comprises a short tube 44 having a head 46. A washer 47 surrounding tube 44 is located adjacent the outside of wall 16 and is secured thereto with head 46 to join assembly 43 to end wall 16. The outer end of tube 44 is closed with a removable plug 48. The tube 44 can be connected with a suitable hose to an air pump, air blower, or a like source of air under pressure. Suitable valves (not shown) can be used to regulate the supply of air under pressure that is carried via tube 44 into chambers 22 of air mattress 10 and exhaust air therefrom.

An air control system for an air bed is disclosed in co-pending U.S. Application Ser. No. 455,664. This air control system has a pump and hand-operated switches for regulating valves and the pump to supply air to air mattresses. The air control system can be used to supply air to apparatus 10.

Figure 20:
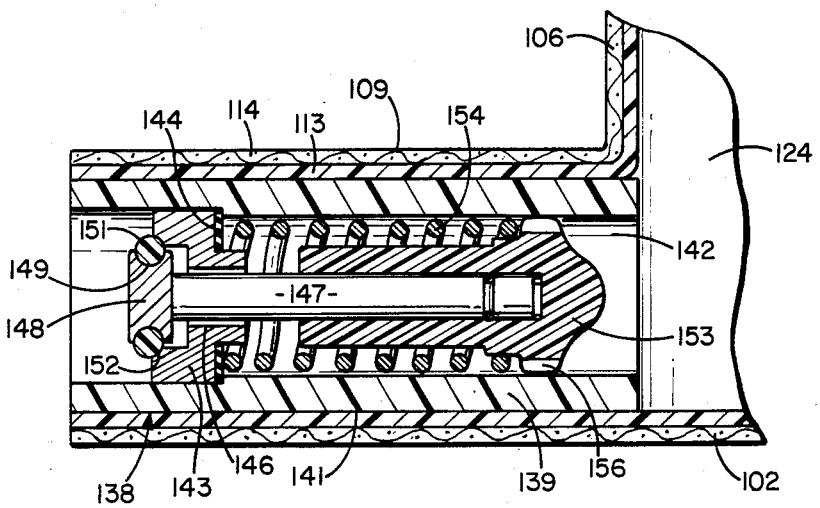
FIG. 20 is an enlarged sectional view taken along the line 20—20 of FIG. 19.

As shown in FIGS. 1, 5, and 8, a one-way air pressure relief valve 49 mounted on end wall 16 prevents over-inflation of air mattress 10, which can cause wall rupture and seam separation. Referring to FIG. 8, valve 49 has a flexible boot 49A supporting a valve body 49B. Boot 49A and valve body 49B are attached to the inside of end wall 16, thereby locating the valve within chamber 22. Valve body 49B is a tubular member accommodating a movable spring biased valving membe, as shown in FIG. 20, operable to open the valve and allow air to flow from chamber 22 to the atmosphere when air pressure in chamber 22 reaches a predetermined value. For example, when the air in chamber 22 reaches a pressure of 1 psi or greater, the valving member will move to the open position thereby venting air from chamber 22 to the atmosphere and reducing the air pressure within the mattress. When the air pressure drops below the maximum value, such as 1 psi, the valve will automatically close. This prevents over-inflation of air mattress 10 and separation of the seams and bursting of the walls thereof. The pressure relief characteristics of valve 49 can be selected to provide for a desired maximum pressure of air in chamber 22 of air mattress 10. Fox example, valve 49 is operable to limit the pressure of air within air mattress 10 to about 1 psi.

Referring to FIGS. 7–10, there is shown a modification of the air mattress of the invention indicated generally at 50. Air mattress 50 is commonly termed an air bag or air bladder used to yieldably support one or more persons in an air bed.

Air mattress 50 has a flexible generally rectangular top wall 51 located over a bottom wall 52. Opposite side walls 53 and 54 and end walls 56 and 57 join the peripheral edges of the top and bottom walls 51 and 52. A continuous upper peripheral seal 58 joins the outer peripheral edge of upper wall 51 to the top edges of the side walls and end walls 53–57. The outer peripheral edge of bottom wall 52 is secured with a continuous lower peripheral seal 59 to the lower edges of the side wall and end walls 53–57. The seals 58 and 59 are continuous air impervious seals so as to maintain the air under pressure within air mattress 50.

The inside of air mattress 50 has a plurality of pairs of transverse internal supports 61 and 62 providing the top and bottom walls 51 and 52 and side walls 53 and 54 with support to minimize the outward expansion or bulging of these walls as a result of the pressure of the gas within air mattress 50. Supports 61 and 62 divide the inside of apparatus 50 into a plurality of transverse gas accommodating chambers 65. Chambers 65 extend between side walls 53 and 54. Air mattress 50 has a series of side-by-side passages that extend from the front end wall 56 to the rear end wall 57.

As shown in FIG. 8, internal support 61 has a generally flat beam having an upper lip 63 secured by a seal or the like to the inside of top wall 51. A lower lip 64 is secured by a seal to the inside of the lower wall 52. Support 61 has a plurality of holes 66. The holes 66 allow support 61 to expand in a generally vertical or upright direction so that the air pressure within chamber 65 causes the top and bottom walls to expand outwardly. This provides the top and bottom walls 51 and 52 with a plurality of outwardly convex curved portions or a tuffed shape. Walls 51 and 52 have a tuffed shape when gas under pressure is stored in the apparatus. Supports 61 and 62 comprise pairs of web-like members that are evenly spaced along the length of the apparatus. As shown in FIG. 9, eight pairs of supports 61 and 62 are incorporated in apparatus 50. Support 61 has an end portion 67 terminating in an ear 68. The ear 68 is secured to the mid-section of side wall 53. Openings 69 and 71 are located above and below end portion 67 and allow gas to flow into adjacent chamber 65. Holes 66 also allow air to flow between adjacent chambers. Support 61 has a second end portion 72 terminating in a lip 73. Lip 73 is secured to the mid-section of side wall 54 to prevent the side wall from bulging outwardly when subjected to air under pressure. The openings 74 and 76 located above and below end portion 72 allow gas to flow into the adjacent chamber 65.

As shown in FIG. 11, the internal support 62 has a web member or beam extending between the top and bottom walls 51 and 52. Support 62 is laterally spaced from support 61 to form a transverse gas chamber. A lip 77 secures the top of support 62 to the inside of top wall 51. In a similar manner, a lip 78 secures the bottom of support 62 to the inside of bottom wall 52. Support 62 has a plurality of holes 79. Holes 79 are laterally offset from holes 66 in support 61. Portions of the top and bottom walls 51 and 52 adjacent the holes 79 bulge outwardly providing the top and bottom walls with shallow convex-shaped portions that are laterally offset from convex-shaped portions formed by holes 66 and support 61. Support 62 has a first end portion 80 terminating in an ear 81. Ear 81 is secured by sonic welds or the like to the mid-portion of side wall 53. Openings 82 and 83 adjacent the upper and lower portions of end portion 80 allow gas to flow into adjacent chamber 65. The opposite end of support 62 has a second end portion 84 terminating in an ear 86. Ear 86 is secured to the mid-portion of side wall 54. Openings 87 and 88 are adjacent upper and lower sides of end portion 84 and allow gas to flow into the chamber 65. Holes 79 also allow gas to flow to adjacent chambers.

Referring to FIG. 12, a generally horizontal end support or web 89 extends along the mid-portion of end wall 56. Support 89 has a pair of lips 91 and 92 secured to the inside of end wall 56 and the first transverse support 61. Support 89 holds end wall 56 in a generally vertical position when the apparatus is inflated with gas. An identical end support (not shown) is secured to the inside of the mid-section of the end wall 57 to maintain its generally vertical shape.

A plug valve assembly 93 is attached to one end of wall 56. Valve assembly 93 is identical to the valve assembly 43 shown in detail in FIG. 6. An elongated flexible tube can be used to connect the valve assembly 93 to a source of air under pressure, such as an air pump. An example of an air pump and air control system is shown in co-pending U.S. Patent Application Ser. No. 455,664, filed Jan. 5, 1983. This application is incorporated herein by reference.

Apparatus 50 is provided with a one-way gas pressure relief valve 94. Valve 94 is mounted on the inside of end wall 56. Alternatively, valve 94 can be located in the seam 59, similar to valve 138 shown in FIGS. 19 and 20. The valve 94 functions to relieve and regulate the maximum air pressure in the mattress. When the pressure exceeds a predetermined limit, such as 1 psi, valve 94 will open to evacuate air from the air mattress. This prevents over-inflation of the apparatus and eliminates the seam separation and bursting of the walls thereof.

Examples of air mattresses are as follows:

The air mattresses are made in different sizes, i.e., twin, full, queen, and king. These mattresses have a width from 39 inches (99 cm) to 84 inches (213 cm). The mattress has a thickness of 4 inches (10 cm) and transverse internal web space 4 inches (10 cm) apart along the length thereof. The walls and webs are made of Nylon vinyl sheet material. An ultrasonic sealing an vulcanization processes are used to make the airtight seams. The air mattress has a high degree of stability, as the air moves transversely in passages 22 when a body rests on top wall 11. Only a controlled restricted amount of air moves longitudinally. The air mattress has a rectangular box shape with generally flat sides and ends. The air mattress fits in the dish support of an air bed. An air pressure relief valve is secured to an end wall of the air mattress. The valve is located within the chamber of the air mattress so that outside objects, as mattress covers, bed structures, and the like do not interfere with the operation of the valves. The valve has a spring biased valving member operable to open the valve when the pressure of the air in the air mattress exceeds 1 psi. The valving member automatically closes when the air pressure in chamber falls below 1 psi.

Referring to FIGS. 13 and 14, there is shown another modification of the air mattress with air pressure relief valve of the invention indicated generally at 100. Air mattress 100 accommodates a compressible fluid, such as air, to yieldably support one or more persons in a horizontal or prone position. Preferably, apparatus 100 is an air mattress, used in an air bed to yieldably support one or more prone persons. Apparatus 100 has an air pressure relief valve 138 operable to limit the internal air pressure to about 1 psi to prevent mattress blow-out.

Air mattress 100 has a generally rectangular top wall 101 located over an identical bottom wall 102. Side walls 103 and 104 and end walls 106 and 107 extend between the top and bottom walls 101 and 102 to complete the outer structure of the air mattress. The top wall 101 and side walls 103, 104 and end walls 106, 107 have a continuous upper peripheral edge 108 that are joined together to form a gas impervious seal. In a similar manner, the bottom wall 102 is joined to the side walls 103, 104 and end walls 106, 107 with a lower outwardly directed peripheral edge 109. As shown in FIGS. 15 and 18, a continuous strip 111 located in the inside of air mattress 100 is positioned over the seam of the upper peripheral edge 108. A strip 111 located inside air mattress 100 is located over the seam of the lower peripheral edge 109. The strips 111 and 112 are vulcanized to their adjacent walls to reinforce the seams of edges 108 and 109.

Figure 17:
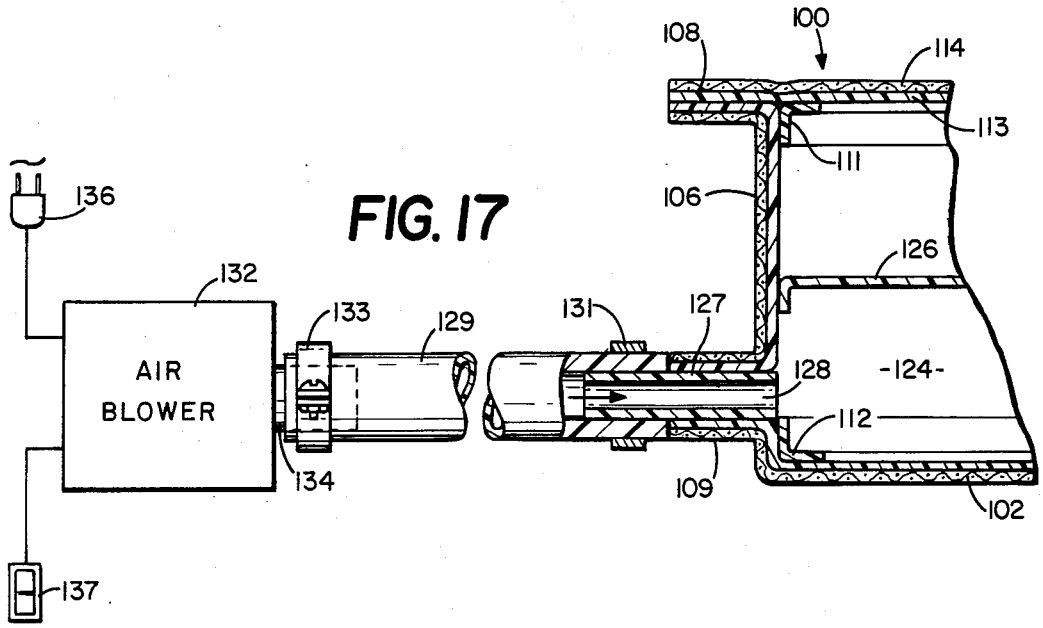
FIG. 17 is an enlarged foreshortened sectional view taken along the line 17—17 of FIG. 14.

As shown in FIGS. 15, 17, and 18, the walls 101, 102, 103, 104, 106, and 107 are fabric and plastic sheets comprising an inner plastic layer 113 and an outer fabric layer 114. Layers 113 and 114 are integrally joined together to form air impervious walls. Plastic layer 113 may be a Nylon vinyl, polyester vinyl or Rayon vinyl. These materials are strong, flexible, air impervious, water resistant, and do not deteriorate over time. Fabric layer 114 is a soft fabric, such as cotton or a synthetic fabric, bonded to the outside surface of layer 113.

The rectangular shape of air mattress 100 is maintained when inflated with air under pressure by a plurality of laterally spaced transverse internal ribs or beams 116. Beams 116 linearly extend between side walls 103 and 104. The upper and lower portions of beams 116 have lips 117 and 118 that are secured to top and bottom walls 101 and 102, respectively. As shown in FIG. 7, the seams formed by the lip 117 terminate in tear drop end portions 119 inwardly from outer edge 108 of top wall 101. End portions 119 strengthen the ends of the seals joining beam 116 to top and bottom walls 101 and 102. Beam 116 has central ears 121 and 122 at the opposite ends thereof secured to the side walls 103 and 104, respectively. Beams 116 are flexible, non-elastic sheet members that prevent the upper and lower walls 101 and 102 from ballooning or bulging outwardly. Beams 116 also divide the interior chamber of air mattress 100 into a plurality of transverse air accommodating passages or chambers 124. Chambers 124 extend transversely across the air mattress and are located side-by-side along the entire length of the air mattress. Openings 123 in each of the corners of transverse beams 116 provide passages for the flow of air into and out of adjacent chambers 124. Holes can be placed in beams 116, such as holes 66 and 79 shown in FIGS. 10 and 11 to provide the top and bottom of mattress with a rounded or tuffed convex curved structure. The adjacent beams 116 are preferably laterally spaced from each other about 10 cm. Other lateral dimensions between beams 116 may be used. Beams 116 form vertical and horizontal reinforcement for the top and bottom walls and side walls of the air mattress so that the air mattress retains a generally box shape as shown in FIGS. 13 and 14 when inflated with air.

Referring to FIG. 18, a generally horizontal rib 126 located in the center of the end chamber 124 is secured to the end wall 106 and adjacent beam 116. Rib 126 reinforces and maintains the generally vertical shape of end wall 106 when the air mattress is inflated. A similar horizontal rib (not shown) is located in the opposite end of the air mattress to reinforce and maintain the vertical shape of end wall 107.

As shown in FIGS. 13 and 17, air mattress 100 is connected to a air blower 132 operable to supply the air mattress with a air under pressure and allow air to exhaust from the air mattress. A tube 127 is located in the seam of the lower peripheral edge 109. Tube 127 is a plastic tubular member that is vulcanized to bottom wall 102 and end wall 106 forming the lower peripheral edge 109. Tube 127 has a passage 128 open to chamber 124 and a hose 129. Hose 129 fits over the outer end of tube 127 and is secured thereto with a ring clamp 131. The opposite end of hose 129 is located about a air outlet tube 134 of air blower 132. A ring clamp 133 holds hose 129 on air outlet tube 134. The air blower 132 has an electric motor (not shown) coupled to a source of electric power with a plug 136. A three-position switch 137 is used to control the operation of the electric motor. The motor drives a fan or impeller that moves air under pressure to hose 129, tube 137 and into air mattress chamber 124. A person lying on the air mattress 124 can utilize switch 137 to operate the air blower to increase the pressure of the air in the air mattress or cause the air in the mattress to be evacuated to atmosphere. An air control system for an air bed is disclosed in pending U.S. Application Ser. No. 455,644. This air controlled system including its pump and valves can be used to supply air under pressure to the air mattress 100. The air controlled system of Application Ser. No. 455,644 is incorporated herein by reference.

Figure 19:
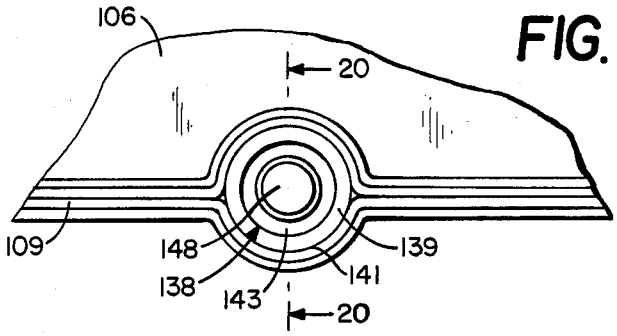
FIG. 19 is an enlarged portion of the outside end of the air mattress and pressure relief valve.

As shown in FIGS. 13, 19, and 20, a one-way pressure relief valve, indicated generally at 138, is incorporated in the lower peripheral 109. The entire valve 138 is located within the confinement of edge 109. The operation of the pressure relief valve is not affected by outside structures, such as mattress covers, bed frames, and the like. Valve 138 operates under all positions of the mattress to maintain a predetermined maximum air pressure in air mattress chamber 124. Preferably, the maximum of air pressure is about 1 psi. An air pressure exceeding 1 psi will open the pressure relief valve 138 allowing air to exhaust to atmosphere thereby relieving the pressure of the air within chamber 124. Air mattress 100 can be used with the pressures below 1 psi. The air blower 132 is used to supply the air under pressure to the mattress. Hand control 137 is used to control the exhaust of air from the mattress and thereby control the pressure of the air within the mattress.

Pressure relief valve 138 has a cylindrical plastic body 139 having a cylindrical surface 141. The outer surface 149 is secured by vulcanization to plastic layers 113 of the bottom wall 102 and end wall 106 forming the lower pheripheral edge 109. Body 139 is permanently secured to plastic layers 113. Body 139 has a linear passage 142 accommodating a plug 143. Plug 143 fits into the outer end of passage 142 with a friction fit and holds an annular seal 144 in engagement with the inside of body 139. Plug 143 has a central hole 146 accommodating a linear rod 147. Rod 147 has as its outer end a cylindrical head 148 having an outer peripheral groove 149. An O-ring 151 fits into groove 149 and engages an annular inclined seat 152 surrounding the outer end of hole 146. Seat 152 is in an outer annular portion of plug 143. Rod 147 extends through hole 146 toward mattress chamber 124. A cup member 153 is snapped onto the inner end of rod 42. Cup member 153 has a plurality of circumferentially spaced ears 156 which allow air to flow past cup member 153 through passage 142. A coil spring 154 is interposed between ears 156 and seal 144 to continuously bias the O-ring 151 into sealing engagement with annular seat 152.

When the pressure of the air in the mattress chamber 124 exceeds the biasing force of spring 154, head 148 will move outwardly thereby moving O-ring 151 away from seat 152 opening passage 146. The air flows past head 148 to atmosphere relieving the pressure of the air in the chamber 124. Valve 138 automatically prevents over inflation of the air mattress and the separation of the seams and the flow-out or bursting of the walls 102, 103, 104, 106 and 107. Head 148 is always located within passage 142 of tube 139 so that outside structures, such as mattress covers, bed frames, and the like do not interfere with the operation of the valve. The pressure relief characteristic of valve 138 is determined by selecting the biasing force of spring 154 to provide a desired maximum pressure of the air in chamber 124. For example, when the biasing force of spring 154 is equal to 1 psi the valve 138 will open when the pressure of the air in chamber 124 exceeds 1 psi.

While there has been shown and described the preferred embodiments of the air mattress with pressure relief valves, it is understood that changes in materials, size, shape, and arrangement of structure may be made by those skilled in the art without departing from the invention. The invention is defined in the following claims.

The embodiments of the invention in which an exclusive property or privilege is claimed are defined as follows:

1. An air mattress accommodating air under pressure for providing a body support comprising: a top wall, a bottom wall spaced from and located below the top wall, side walls and end walls secured to said top and bottom walls, all of said walls comprising flexible air impervious sheet members sealed together along the edge portions thereof to form a chamber for accommodating gas under pressure, seam means securing adjacent portions of the sheet means together, a plurality of support means located in said chamber extended between said side walls and secured to said top and bottom walls providing transverse passages accommodating air and limiting outward expansion of the top and bottom walls when air under pressure is stored in said chamber, each of said support means having a web section and opposite end portions secured to said side walls to limit outward expansion of the side walls when air pressure is stored in said chamber, each of said end portions having at least one opening allowing air communication between said transverse passages, tube means mounted in the seam means to facilitate supplying air under pressure into said chamber, and air pressure relief valve means mounted in the seam means open to said chamber and atmosphere, said valve means having a cylindrical body secured to the seam means, said body having a passage open to said chamber and atmosphere, an annular plug having a center hole located within said passage in engagement with said body, valving means located in said passage engageable with said plug to close said passage, said valving means including a rod having an outer end extended through said center hole, a head joined to said outer end of the rod engageable with the plug to close said center hole and a member mounted on the rod; and spring means engageable with said plug and member to bias said head in sealing engagement with said plug to maintain the pressure of air in said chamber, said spring means having a biasing force that allows the head to move away from the plug when the pressure of the air within the chamber exceeds a selected maximum limit whereby air is vented from said chamber.

2. The air mattress of claim 1 wherein: all of the walls and support means are combined fabric and plastic sheet members, said body being secured to said plastic sheet members in the seam means.

3. The air mattress of claim 1 including: end webs located in said chamber secured to said end walls and a support means to limit outward expansion of the end walls.

4. The air mattress of claim 3 wherein: said end webs are sheet members located between said top and bottom walls and extended generally parallel thereto.

5. The air mattress of claim 1 wherein: said member mounted on the rod has a plurality of ears slidably engageable with said body.

6. The air mattress of claim 1 wherein: said support means have a plurality of holes allowing said top and bottom walls to expand outwardly to form a plurality of outward convex curved portions therein.

7. The air mattress of claim 6 wherein: adjacent support means have transverse offset holes.

8. An air mattress accommodating air under pressure for providing a body support comprising: a first wall, a second wall spaced from the first wall, side walls and end walls secured to said first and second walls to form a chamber for accommodating air under pressure, all of said walls comprising flexible gas impervious sheet members, edge means securing said walls together to enclose said chamber, a plurality of support means located in said chamber extended between said side walls and secured to said first and second walls and side walls providing transverse passages accommodating gas and limiting outward expansion of the first and second walls and side walls when gas under pressure is stored in said chamber, tube means mounted in said edge means to facilitate supplying air under pressure into said chamber, and pressure relief valve means mounted within said edge means operable to limit the air pressure in said chamber, said valve means having a cylindrical body secured to said edge means, said body having a passage open to the said chamber and atmosphere, a plug having a center hole located within said passage and in engagement with said body, a valving member located in said passage and engageable with said plug to close said passage, said valving member including a rod having an outer end extended to said center hole, a head joined to said outer end of the rod, engageable with said plug to close the center hole, and a member mounted on the rod, and biasing means engageable with said plug and member to bias said head into sealing engagement with said plug to maintain the pressure of the air in said chamber, said biasing means having a biasing force that allows the head to move away from the plug when the pressure of the air within the chamber exceeds a selective maximum limit whereby air is vented from said chamber.

9. The air mattress of claim 8 wherein: all of said walls and support means are combined fabric and plastic sheet members, said edge means securing the walls together comprising seam means, said valve means being located within the seam means.

10. The air mattress of claim 8 wherein: said member on the rod has a plurality of ears slidably engageable with said body.

11. The air mattress of claim 8 wherein: the biasing means has a biasing force that allows the valving member to move to its open position where the pressure of the air within the chamber exceeds about 1 psi.

12. The air mattress of claim 8 wherein: said support means has a plurality of holes allowing said first and second walls to expand outwardly to form a plurality of outward convex curved portions therein.

13. The air mattress of claim 12 wherein: adjacent support means have transverse offset holes.

14. An air mattress comprising: a first wall, a second wall, said first and second walls having opposite side edges, side walls joined to adjacent opposite side edges of the first and second walls, end walls joined to adjacent opposite end edges of said first and second walls, seam means securing and sealing adjacent edges together to form an enclosed chamber for accommodating air under pressure, a plurality of webs located within said chamber forming a plurality of air accommodating passages, means securing said webs to said walls whereby said webs concurrently limit outward expansion of said first and second walls and said side walls, means mounted on one of said walls useable to supply fluid to said chamber, and air pressure relief valve means located within the seam means operable to limit the air pressure in said chamber, said valve means including a cylindrical body secured to the seam means, said body having a passage open to said chamber and atmosphere, an annular plug having a center hole located within said passage and in engagement with said body, valving means located in said passage engageable with said plugs and close said passage, said valving means including a rod having an outer end extended through said center hole, a head joined to said outer end of the rod engageable with said head to close the center hole, and a member mounted on the rod; and biasing means engageable with said plug and member to bias said head in sealing engagement with said plug to maintain the pressure of the air in the chamber, said biasing means having a biasing force that allows the head to move away from the chamber when the pressure of the air within the chamber exceeds a selected maximum limit whereby air is vented from said chamber.

15. The air mattress of claim 14 wherein: each of said webs have a plurality of holes allowing said first and second walls to expand outwardly to form a plurality of outward convex curved portions therein.

16. The air mattress of claim 15 wherein: adjacent webs have transverse offset holes.

17. The apparatus of claim 14 wherein: all of the walls are combined fabric and plastic sheet members.

18. The air mattress of claim 14 wherein: each of said webs have opposite end portions, said opposite end portions having holes providing air communication between adjacent passages for accommodating air under pressure.

19. The air mattress of claim 14 wherein: said member mounted on the rod has a plurality of ears slidably engageable with said body.

20. The air mattress of claim 14 wherein: the biasing means has a biasing force that allows the valving member to move to its open position where the pressure of the air within the chamber exceeds about 1 psi.

* * * * *